US012173466B2

(12) United States Patent
Arntz

(10) Patent No.: US 12,173,466 B2
(45) Date of Patent: Dec. 24, 2024

(54) FOUNDATION PILE

(71) Applicant: GBM WORKS IP B.V., Amsterdam (NL)

(72) Inventor: Bernardus Johannes Maria Arntz, Gravenhage (NL)

(73) Assignee: GBM Works IP B.V., Utrecht (NL)

( * ) Notice: Subject to any disclaimer, the term of this patent is extended or adjusted under 35 U.S.C. 154(b) by 336 days.

(21) Appl. No.: 17/601,970

(22) PCT Filed: Apr. 2, 2020

(86) PCT No.: PCT/EP2020/059444
§ 371 (c)(1),
(2) Date: Oct. 7, 2021

(87) PCT Pub. No.: WO2020/207903
PCT Pub. Date: Oct. 15, 2020

(65) Prior Publication Data

US 2022/0205208 A1 Jun. 30, 2022

(30) Foreign Application Priority Data

Apr. 9, 2019 (NL) ..... 2022909
Aug. 6, 2019 (NL) ..... 2023612
(Continued)

(51) Int. Cl.
*E02D 7/28* (2006.01)
*E02D 7/18* (2006.01)
*E02D 11/00* (2006.01)

(52) U.S. Cl.
CPC ..... *E02D 7/28* (2013.01); *E02D 7/18* (2013.01); *E02D 11/00* (2013.01)

(58) Field of Classification Search
CPC ..... E02D 7/28; E02D 7/18; E02D 11/00
See application file for complete search history.

(56) References Cited

U.S. PATENT DOCUMENTS 3,620,026 A * 11/1971 Mallard ..... E02D 7/28
294/98.1
5,653,556 A 8/1997 White
10,597,841 B2 * 3/2020 Arntz ..... E02D 5/72

FOREIGN PATENT DOCUMENTS

CN 101498129 A 8/2009
CN 106087950 A 11/2016
(Continued)

OTHER PUBLICATIONS

International Search Report and Written Opinion for PCT/EP2020/059444; Jul. 22, 2020; 15 pgs.

*Primary Examiner* — Janine M Kreck
(74) *Attorney, Agent, or Firm* — Perilla Knox & Hildebrandt LLP

(57) ABSTRACT

The invention is directed to a foundation pile (1) comprising a tubular housing (2) having an upper end (3) and an open lower end (4) and wherein at the upper end or near or at the open lower end (4) vibration means are present and wherein at the open lower end means (6) to discharge a fluid into the interior space (20) of the tubular housing and means (7) to discharge a fluid from the lower end (4) of the tubular housing (2) in a direction which has a downward directional component. The means (6) to discharge a fluid into the interior space (20) of the tubular housing have can fluidise the soil present in this interior space.

20 Claims, 7 Drawing Sheets

(30) Foreign Application Priority Data

Figure 1:
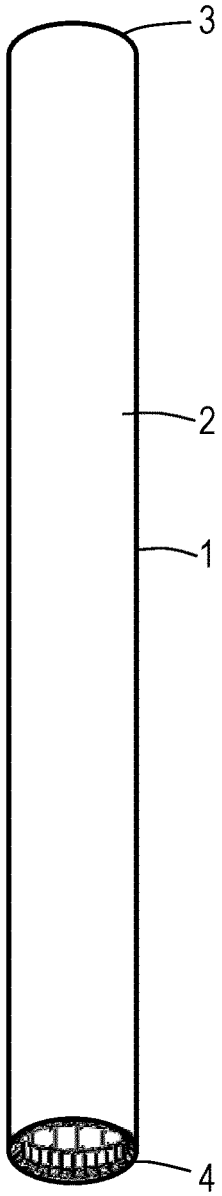

Sep. 27, 2019 (NL) ..... 2023914
Dec. 5, 2019 (NL) ..... 2024392

(56) References Cited

FOREIGN PATENT DOCUMENTS

| | | | |
|---|---|---|---|
| GB | 1120165 | A | 7/1968 |
| JP | 10971936 | A | 3/1997 |
| NL | 2021129 | A | 6/2018 |
| WO | 0218711 | A1 | 3/2002 |
| WO | 03100178 | A1 | 12/2003 |
| WO | 2015190919 | A2 | 12/2015 |
| WO | 2017203023 | A1 | 11/2017 |
| WO | 2018151594 | A1 | 8/2018 |

* cited by examiner

FOUNDATION PILE

The invention is directed to a foundation pile comprising a tubular housing having an upper end and an open lower end and wherein at or near the open lower end means are present to discharge a fluid.

WO03/100178 describes a method to install a wind turbine at sea by vibrating a tubular foundation pile of a so-called monopile into the earth using a vibration arrangement clamped to the upper end of the foundation pile. The vibration arrangement may weigh 40-50 tonnes and may be one as described in U.S. Pat. No. 5,653,556. Once the tubular foundation pile is installed an intermediate part and a wind turbine tower is fixed to the tubular foundation. Next a nacelle and hub and blades are mounted.

WO15190919 described a method to upend, bring into a vertical position, of a combined foundation pile and a vibrating arrangement similar to the one disclosed in WO03/100178.

WO02/18711 describes a hammer fixed to the upper end of a foundation pile. The hammer is provided with eccentric rotatable weights which may be electrically or hydraulically powered. The pile can be installed in the soil of a sea bed.

WO2017/203023 describes a tubular foundation pile having an open lower end. The lower end of the tube is provided with an array of moving tips which movement is caused by rotating eccentric masses powered by a hydraulic motor. Further the tips are provided with outlet openings for water to achieve an upwardly moving flow of water along the outer and inner wall of the tube. When installing a foundation pile of this design significantly lower noise levels would result because it would avoid the use of a 40-50 tonnes weight vibration device.

Although the design of WO2017/203023 is beneficial in many ways there is still room for improvement. For example, it appears that when the foundation pile of WO2017/203023 is used in harder soil it becomes difficult to penetrate this soil to a sufficient depth for the pile to serve as a foundation for, for example, a wind turbine. The object of the present invention is therefore to provide a foundation pile which avoids or reduces the use of a noise generating vibration device described WO03/100178 and which has an improved soil penetration as compared to the foundation pile as described in WO2017/203023.

This is achieved by the following foundation pile. A foundation pile suited to move downwards into a soil and comprising a tubular housing having an upper end and an open lower end and wherein at the upper end or near or at the open lower end vibration means are present, and wherein at the open lower end means to discharge a fluid into the interior space of the tubular housing and means to discharge a fluid from the lower end of the tubular housing in a direction which has a downward directional component.

Applicant found that the foundation pile according to the invention can penetrate a soil deeper than the prior art foundation pile described in WO2017/203023. Applicants found that the soil resistance can be effectively reduced by fluidising the soil which is present within the tubular housing at the lower end when it penetrates the soil and not only the soil which is present at the inner and outer wall of the tubular housing as in WO2017/203023. This in combination with the vibration means and the discharge of the fluid in a downward direction results in that the foundation pile effectively penetrates the soil. The prior art vibration means clamped to the upper end of the foundation tube as described above may be advantageously used in this invention whereby it is found that the vibration means can operate at a lower noise level. The invention is therefore also directed to the following process.

Process to install a foundation pile comprising a tubular housing having an upper end and an open lower end into a mass of soil by making use of the gravitational forces resulting from the mass of the foundation pile and any optionally connected part to said foundation pile in the downward axial direction and wherein the soil resistance, which prevents the foundation pile from penetrating the soil, is reduced by (a) vibrating the tubular housing using a vibration means located at the upper end of the foundation pile or near or at the open lower end of the tubular housing, (b) fluidising the soil as present in the interior of the tubular housing using water as a fluidising medium and (c) discharging downward projected jets of water from the lower end of the tubular housing.

In the description of the invention terms like upper, lower, upwardly downwardly, upward, downward, above, below are used to describe the invention in its most typical configuration when used as a foundation pile. This language does not in any manner limit the invention to such configuration. Thus foundation piles having another position, for example lying horizontally in storage, may still be according to the present invention.

The terms fluidisation, fluidising, fluidised bed as used in this description all relate to the physical state where the amount of fluid added to the interior of the tubular housing is such that the soil as present in the interior of the tubular housing becomes suspended in the fluid. The upward drag forced of the fluid on the soil particles will then equal the gravitational forced on said soil particles. The resulting suspension of soil particles in the fluid will then exhibit a fluidic behaviour. The resulting fluidised bed will conform to the volume of the interior space of the tubular housing. Thus all of the soil or soil particles as present in the interior space of the tubular housing, or at least the soil at and above the means to discharge a fluid into the interior space of the tubular housing, will be in a fluidised state or said otherwise form the fluidised bed according to this invention.

The lower end of the foundation pile according to the invention may be provided with an array of moveable tips as described in WO2017/203023 in addition to the means (i)-(iii). Preferably the lower end of the foundation pile is a fixed or non-moving arrangement, preferably this lower end is a downward directed non-moving pointed end.

The vibration means may be present at the upper end of the foundation pile. Such vibration means may be the known vibration means as for example described in the earlier referred to publications WO03/100178, WO15190919 and WO02/18711. Preferably such a vibration means comprise a clamping mechanism for fixedly clamping the upper end of the foundation pile, a vibrator block configured to provide a vibration for the purpose of inserting the foundation pile into the soil or ground. The vibration block may comprise resilient elements and a fixation mechanism configured to a apply a prestress to the resilient means. Such vibration means do cause noise when used. However the level of noise is reduced due to the additional measures of fluidising the soil and discharging a fluid in a downward direction according to the invention. When the noise levels are to be further reduced it is preferred to have the vibration means present at or near the open lower end of the foundation pile. The energy level of the source of vibration and thus also the noise level may be significantly lower as compared to when a vibration means are located at the upper end of the foundation pile as shown in WO03/100178. Furthermore the noise caused by the vibrating means will be effectively damped by the surrounding soil and by the length of the foundation pile which is already surrounded by soil when penetrating the soil.

The vibration means may be positioned at the outer wall of the tubular housing near the lower end of the tubular housing. Preferably the vibration means are a series of individual vibration devices positioned at the interior wall of the tubular housing near the lower end of the tubular housing. By near is here preferably defined that the distance between the vibration device and the lower end of the foundation pile is less than internal radius of tubular housing. The vibration devices are preferably at the interior wall of the tubular housing because of the local fluidised bed causing a low soil friction.

The individual vibration device suitably comprises of a motor connected to a rotating eccentric mass which in use results in a vibration of the foundation pile. The motor may be an electric, pneumatic or hydraulic motor. Preferably the motor is a hydraulic motor. An advantage of a hydraulic motor is that water used to power the hydraulic motor may be discharged via the means (ii) to discharge a fluid into the interior space of the tubular housing. In this way less fluid is required to be directly fed to such means (ii). The hydraulic motor will be connected to a supply for water, preferably supplying water from a more elevated position.

Vibration means making use of an eccentric mass are known as for example described in the aforementioned WO0218711. The vibration means may be positioned to effect an axial vibration, a tangential or torsional vibration and/or a radial vibration. Preferably the individual vibration devices are positioned such that at least one of an axial vibration or a tangential (torsional) vibration results. Therefore the axis of rotation of the eccentric mass or masses of the individual vibration devices are preferably directed in a radial direction with respect to the tubular housing.

Suitably the individual vibration devices are positioned in a ring along the interior wall of the tubular housing. The rotating eccentric masses of the individual vibration device are suitably rotatably interconnected such to synchronise their motion. Applicants believe that such a ring of interconnected eccentric masses is new and inventive and therefore the invention is also directed to a vibration device comprising of multiple rotating eccentric masses which are rotatably interconnected such to synchronise their motion and are placed in a ring shaped housing. The rotating eccentric masses are suitably connected to one or more electric, pneumatic or hydraulic motors. The axis of rotation of the eccentric masses are suitably directed in a radial direction with respect to the ring shaped housing. The vibration device is suitably used as a means to install a foundation pile into soil. Suitably the vibration device is suitably detachably connected to a lower end part of the foundation pile such that it can be removed once the pile is installed. Other preferred features of the vibration device may be those described in this description and figures of this application. For example the vibration device may be provided with fluid outlet openings as described for the foundation pile.

The means to discharge a fluid into the interior space of the tubular housing have the function to provide enough fluid to fluidise the soil present in this interior space when the foundation pile moves downwards into the soil. Therefore preferably the means to discharge a fluid into the interior space of the tubular housing have the capacity to provide enough fluid to fluidise the soil present in this interior space when, in use, the foundation pile moves downwards into the soil. Preferably the fluid is discharged through more than one outlet openings in a direction having a tangential directional component. Such a fluid supply is advantageous because a larger volume of soil may be fluidised and less channeling will occur resulting in a further reduction of the soil resistance. The tangential directional component are arranged such that a swirl or vortex may result in the interior space of the tubular housing. The tangential directional component will then be in the same tangential direction. Preferably more than 20% of the fluid being discharged into the interior space has a tangential directional component. The optimal amount of fluid discharged with a tangential component will depend for example the velocity and the force at which it is discharged.

The outlet openings having a tangential directional component are preferably positioned at a more radially outer position such to enhance a vortex of soil within the interior space of the tubular housing. Preferably these outlets are positioned at the inner wall of the tubular housing. The number of outlets are suitably at least two. More outlets will further enhance the creation of the vortex. When two outlets are used it is preferred that they are positioned 180 degrees relative to each other along the circular inner wall of the tubular housing. In use a vortex of the suspension of soil and fluid will be created in the lower part of the interior space of the tubular housing at the elevation where the fluid is tangentially discharged. This vortex will extend upwards. Due to friction between the particles and because of the viscosity of the fluid the vortex may not extend the entire height of the fluidised bed. Applicants found that even a vortex only in the lower part of the fluidised bed will further enhance movement of the foundation pile into the soil.

The means to discharge a fluid are suitably an array of more than one outlet openings arranged in a ring along the interior wall of the tubular housing and wherein the direction of the fluid has an upward and an inward directional component. More preferably the direction of the fluid as being discharged also has a tangential directional component. Suitably these means to discharge a fluid are fluidly connected to fluid supply conduits which supply a fluid from the upper end of the foundation pile. The means to discharge a fluid may also be fluidly connected to a fluid outlet of a hydraulic motor of the vibration means. The supply of fluid may be separate such that one group of outlet openings are fluidly connected to a fluid outlet of a hydraulic motor of the vibration means and another set of outlet openings are fluidly connected to the fluid supply conduits.

Suitably the means to discharge a fluid into the interior space of the tubular housing further comprise more than one outlet openings to discharge a fluid along the interior wall of the tubular housing. The outlet openings will be arranged in a ring and the direction of the fluid has an upward direction along the inner wall of the tubular housing. More preferably the direction of the fluid as being discharged also has a tangential directional component.

Preferably the lower end of the tubular housing is a ring shaped element having a downwardly pointed end. The ring shaped element is preferably provided with an array of fluid outlet openings suited to discharge a fluid from the lower end of the tubular housing in a direction which has a downward directional component. The ring shaped element may have an angled, also referred to as pointed, outer surface and/or an (pointed) angled inner surface. With angled or pointed surface is meant any surface which does not run parallel to the outer or inner wall of the tubular housing. For example the outer surface may be angled and the inner surface may be parallel. In such a configuration the outer surface may be provided with outlet openings to discharge a fluid downwardly and radially outwardly. At the lower pointed end of such a ring shaped element outlet openings may be present which direct the fluid in a downward direction.

Preferably the ring shaped element has a pointed inner surface and wherein the pointed inner surface is provided with outlet openings to discharge a fluid from the lower end of the tubular housing in a direction which has a downward directional component and a component in the direction of the axis of the tubular housing. More preferably at the lower pointed end of the ring shaped element outlet openings are present which direct the fluid in a downward direction. Such a ring shaped element is further provided with outlet openings at the outer surface to discharge a fluid from the lower end of the tubular housing in a direction which has a radial outward directional component.

The ring shaped element may comprise of a ring of the afore mentioned vibration means positioned above the means to discharge a fluid from the lower end of the tubular housing. The ring shaped element may further comprises a ring of the afore mentioned outlet openings to discharge a fluid into the interior of the tubular housing positioned above the ring of vibration means. The ring shaped element having such combined functionalities may be fixed to the inner wall of the tubular housing in a permanent manner, such as for example by means of welding or bolted. The ring shaped element may also be detachably connected to the interior wall of the tubular housing. For example by means of hydraulic operated cross bars which press the ring shaped element onto the inner wall. Such cross-bars may also be provided with outlet openings for a fluid. More preferably the direction of the fluid as being discharged from these cross-bars have a tangential directional component. This may be achieved by having a number of discharge openings along one side of the cross-bars. A detachable ring shaped element is advantageous because it enables one to reuse the relatively complex element in another foundation pile according to the invention.

The tubular housing of the foundation pile may be made of every material. Because the vibration means are located at the lower end of the foundation pile materials may be used which would not have survived a vibration or hammering means fixed to its upper end. Tubular housings made of composites such as being developed by Jules Dock, Rotterdam, The Netherlands for wind turbines may be used. The tubular housing is suitably made of steel because steel is currently the material of choice in this industry.

The foundation pile may have any dimension. Preferably the internal diameter of the tubular housing is at least 1 meter such to accommodate the means (i)-(iii). There is not real maximum internal diameter. Tubular housings having internal diameters of up to 50 meter may be used.

The foundation pile may be any foundation pile which needs to be fixed in soil. The foundation pile according to the invention is advantageously used in a soil covered by a body of water, like in a lake or sea. In this way the fluidisation of the soil within the tubular housing will be most effective in reducing the soil resistance. The foundation pile may be an anchor onto which a larger structure may be placed. For example a number of installed foundation piles according to the invention and positioned in a fixed pattern may be used to fix a foundation of a wind turbine having inserts according to the same pattern. The foundation may then be a framework or the like.

The foundation pile may suitably be part of a monopile of a wind turbine. Preferably the tubular housing is a metal tubular housing having a diameter of at least 1 meter and wherein the upper end of the tubular housing is connected to a monopile transition piece of a wind turbine. Even more preferably the tubular housing is a metal tubular housing having a diameter of at least 1 meter and wherein the upper end of the tubular housing is connected to a monopile comprising a wind turbine. Installing the foundation pile making use of means (i)-(iii) while a complete wind turbine is connected to the foundation pile is advantageous because the mass of the wind turbine will assist in the installation of the foundation pile. Lifting devices as disclosed in WO2018/151594 or NL2021129 can be used to position such a complete wind turbine in a vertical position on the sea bed after which the foundation pile according to this invention can install itself making use of means (i)-(iii). Alternatively the process according to this invention may be used to install such a foundation pile with monopile transition piece or the entire monopile wind turbine.

In the process according to this invention the foundation pile comprising a tubular housing having an upper end and an open lower end is installed into a mass of soil by making use of the gravitational forces resulting from the mass of the foundation pile and any optionally connected part to said foundation pile in the downward axial direction. The soil resistance, which prevents the foundation pile from penetrating the soil, is reduced by (a) vibrating the tubular housing using a vibration means located at or near the open lower end of the tubular housing, (b) fluidising the soil as present in the interior of the tubular housing using water as a fluidising medium and (c) discharging downward projected jets of water from the lower end of the tubular housing.

The frequency of the vibration means is suitably between 10 and 200 Hz. The direction of the vibrating tubular housing may be axial, torsional and/or radial and more preferably at least axial and/or torsional. The amount of fluid supplied to the interior of the tubular housing is such that the soil as present in this space is fluidised. The amount of fluid, like for example the amount to achieve the minimum fluidisation velocity, will mainly depend on the type of soil and can be determined by one skilled in the art using ordinary fluidised bed reactor engineering guidelines. The minimum fluidisation velocity is mostly dependent on the particle size and particle density of the soil and fluid viscosity and fluid flow velocity.

The fluid may be water, air or their mixtures. The fluid is suitably fresh water or sea water. When the process is advantageously applied in a soil covered by a body of water, like in a lake or sea, the fluid is preferably water as obtained from this body of water optionally in admixture with air.

The water as added to the interior of the tubular housing may be discharged or collected from the foundation pile at a higher elevation. This higher elevation in the tubular housing is suitably above the created fluidised bed. For example the water may simply flow over the upper edge of an open ended tubular housing. In case of a foundation pile installed in a soil covered by a body of water, like in a lake or sea, the water will then be discharged into this body of water. The water may also be collected from the interior of the tubular housing such that it can be stored and/or cleaned by for example filtration. The cleaned water may then be returned to the body of water. In a preferred method the water collected at the higher elevation comprising soil particles is reused as collected as the water supplied to the interior of the tubular housing and optionally as the downward projected jets of water. The use of such a recycled suspension is advantageous because the process may then be performed using a lower volume flow and/or performed at lower outflow velocities to achieve the same fluidisation in the interior space.

In the process the vibration is achieved by using a number of individual vibration devices comprising of a hydraulic motor connected to a rotating eccentric mass as positioned in a ring along the interior wall of the tubular housing which in use results in a vibration of the tubular housing and wherein the rotating eccentric masses of the individual vibration device are rotatably interconnected such to synchronise their motion. The hydraulic motor is powered by a flow of water and wherein preferably the used water is used for fluidising the soil as present in the interior of the tubular housing.

The process is preferably performed using a foundation pile according to the invention. When a detachable ring shaped element is used it is preferred that this element is pulled upwards within the tubular housing once the foundation pile reached its desired penetration depth.

The vibration device as described above may also be advantageously used in a method to decommission an installed foundation pile. The soil resistance may be reduced in a similar manner when lifting a foundation pile as when installing a foundation pile as explained above. When the vibration device is not removed from an installed foundation pile it may be connected to a water supply and lifted while supplying water to the vibration device as present at the lower open end of the installed foundation pile. Preferably the foundation pile to be decommissioned does not comprise of such a vibration device. For such a foundation pile the below process may be advantageously used.

Process to decommission a foundation pile as installed in a mass of soil wherein the foundation pile comprises a tubular housing having an upper end and an open lower end by (i) lowering a detachable fluidisation device from a higher elevation in the installed foundation pile to the surface of the soil, (ii) fluidising the soil as present in the interior of the tubular housing and below the surface of the soil by discharging water as a fluidising medium via the detachable fluidisation device as it enters the soil as present in the interior of the tubular housing and moves downwards, (iii) fixing the detachable fluidisation device to the open lower end of the tubular housing, (iv) vibrating the tubular housing using a vibration means located at the upper end of the foundation pile or comprised in the detachable fluidisation device and lifting the foundation pile from the mass of soil.

Preferably the fluidising the soil as present in the interior of the tubular housing as performed when the device moves downwards is continued while performing steps (iii) and/or (iv).

Preferably water is discharged from the detachable fluidisation device in a downward direction while performing steps (ii), (iii) and/or (iv) and more preferably while performing steps (ii), (iii) and (iv).

The above decommissioning process may suitably be performed using the detachable fluidisation device as described in this application and figures.

The invention shall be described by the following non-limiting FIGS. 1-11.

FIG. 1 shows a foundation pile (1) comprising a tubular housing (2) having an upper end (3) and an open lower end (4).

Figure 2:
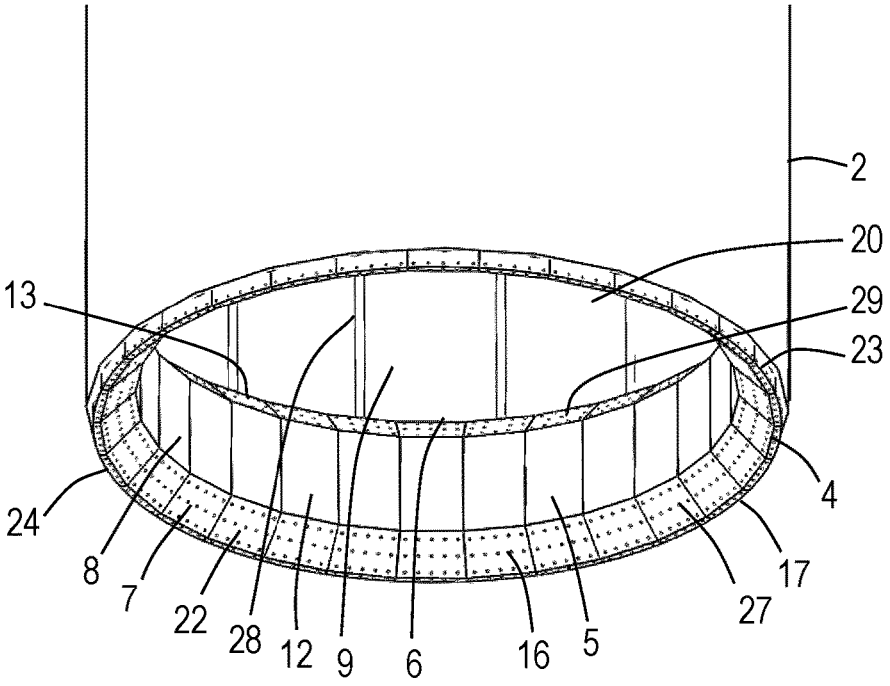

FIG. 2 shows the open lower end (4) of the foundation pile of FIG. 1 in more detail. At this lower end (4) vibration means (5), means (6) to discharge a fluid into the interior space (20) of the tubular housing and means (7) to discharge a fluid from the lower end (4) of the tubular housing (2) in a direction which has a downward directional component. The individual vibrating devices (8) forming the vibration means (5) are present in a ring (12). The means (6) to discharge a fluid into the interior space (20) of the tubular housing are present in a ring (13) of an array outlet openings (29). The means (7) to discharge a fluid from the lower end (4) of the tubular housing (2) are outlet openings (16) as present in a ring shaped element (17). The outlet openings (16) are present in a pointed inner surface (22) which has the shape of a frusto conical shaped surface (27). Fluid discharged from openings (16) flow in a direction which has a downward directional component and a component in the direction of the axis (24) of the tubular housing (2).

In FIG. 2 the ring (12) and ring (13) are part of the ring shaped element (17). Such a ring shaped element (17) may be detachably connected to the interior wall (9) of the tubular housing (2). Also shown are an array of outlet openings (23) located at the exterior of the ring shaped element. Further several conduits (28) are present running along the interior wall (9) to separately supply water to the vibration means (5), means (6) and means (7). In this way the different means can be supplied with water having a capacity and pressure optimised for the different means.

Figure 3:
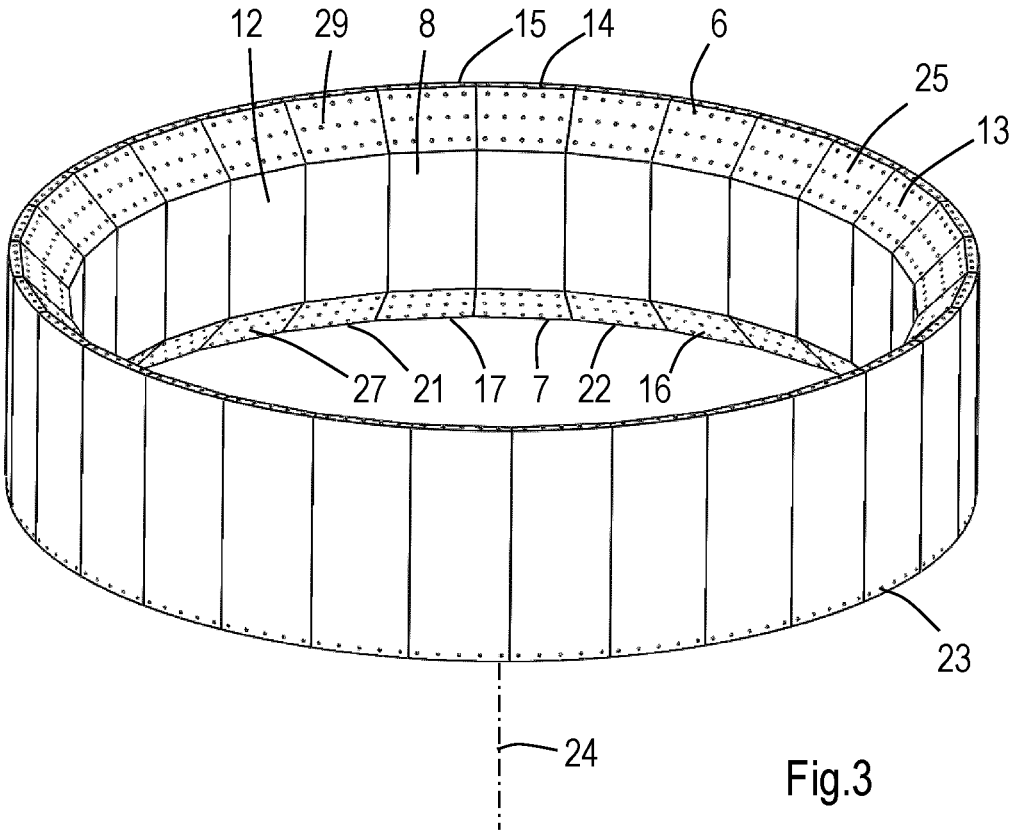

FIG. 3 shows the ring shaped element (17) of FIG. 2 as a separate element. An array of outlet openings (29) are shown which are arranged in a ring (13) as the means (6) to discharge a fluid into the interior space (20) of the tubular housing (2). The outlet openings (29) are positioned in a frusto-conical shaped surface (25) such that any fluid being discharged from said openings have an upward and an inward directional component. Further an array of outlet openings (14) are shown at the upper end of the frusto-conical shaped surface (25) such that any fluid being discharged from said openings has an upward direction along the interior wall (9) of the tubular housing (2). FIG. 3 also shows an array of outlet openings (23) located at the exterior of the ring shaped element. Via these openings (23) a jet of fluid can be discharged sideways thereby further lowering the soil resistance. When the ring shaped element (17) has such external openings (23) it is preferred that the ring shaped element extends somewhat below the lower end of the tubular housing (2) such that these openings have a clear outflow space as shown in FIG. 2.

Figure 4:
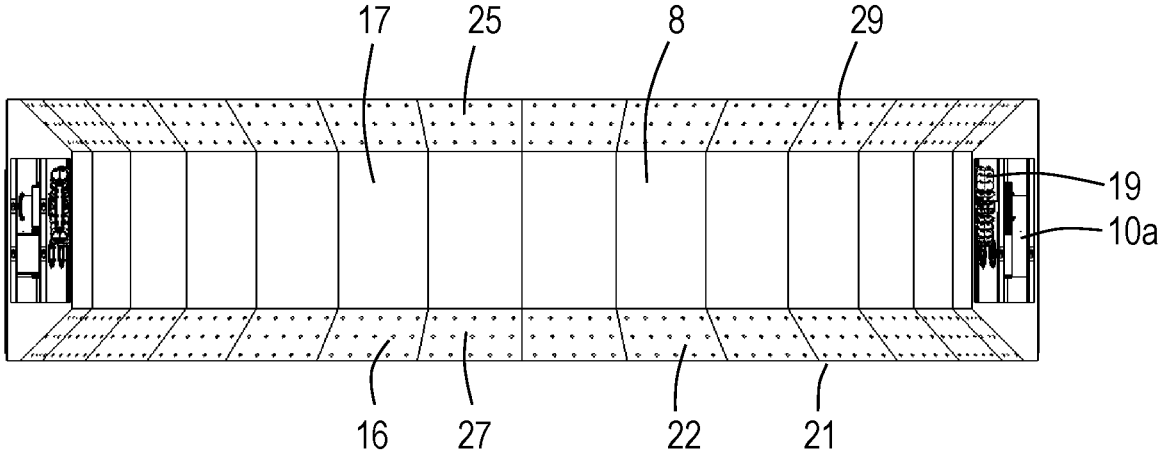

FIG. 4 shows a cross-section of the ring shaped element (17) of FIG. 3. The gear wheel of eccentric mass (10*a*) of one device (8) is connected the gear wheel of eccentric mass (10*b*) of its neighbouring device (8). In this way the multiple rotating eccentric masses as present in the ring shaped element (17) are rotatably interconnected such to synchronise their motion.

Figure 5:
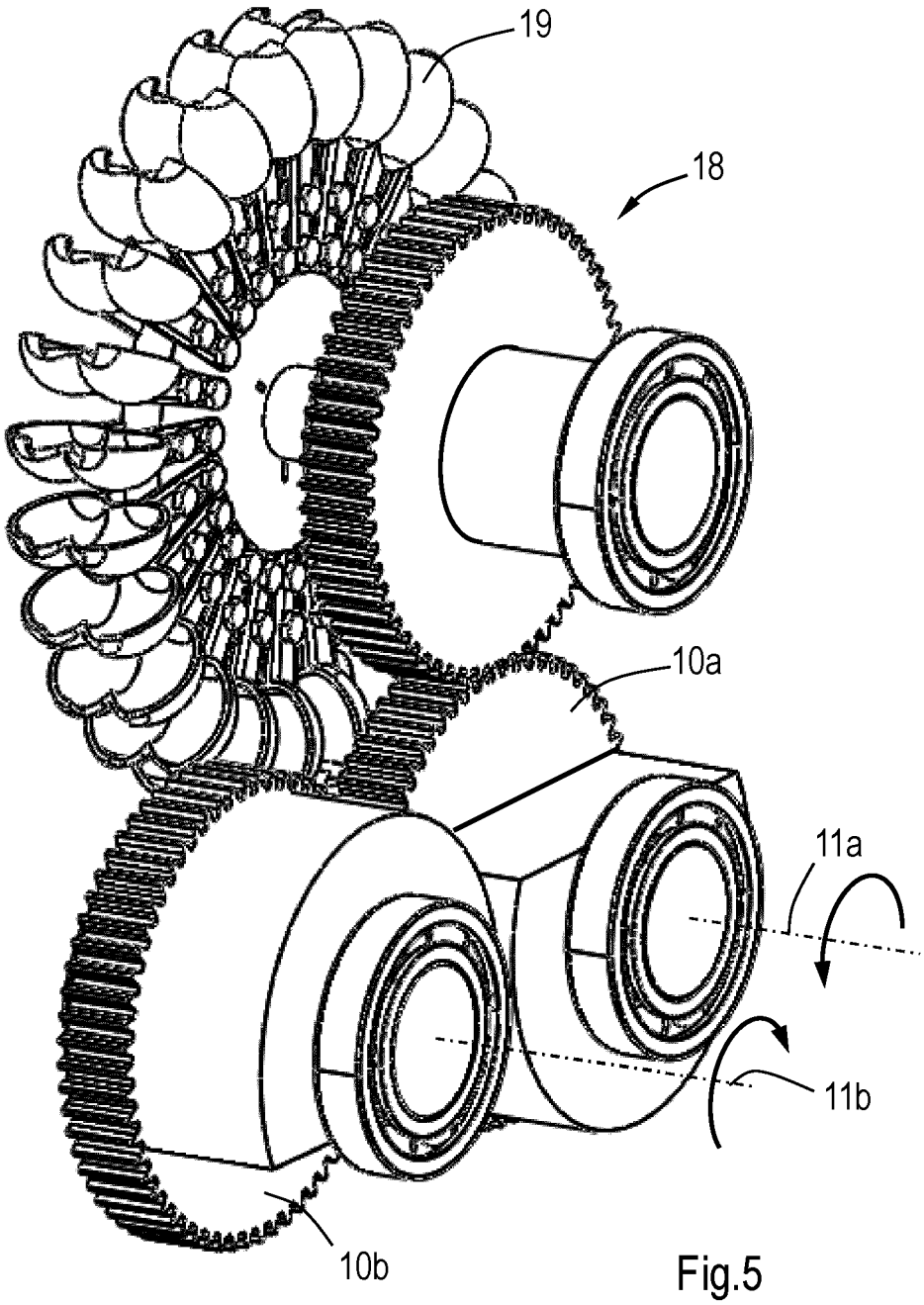

FIG. 5 shows the interior of a vibrating device (8). A bucket wheel (19) as the hydraulic motor (18) is seen. A flow of water will impact a wheel (19) of the hydraulic motor (18) tangentially resulting in a rotation. This rotation is transferred by means of a gearing wheel to a rotating eccentric mass (10*a*) which in turn transfers its rotation by means of a gearing wheel to a second eccentric mass (10*b*). use results in a vibration of the tubular housing (2). The eccentric masses (10*a*, 10*b*) rotate around their respective axis of rotation (11*a*, 11*b*). Because the vibration device is fixed to the tubular wall (2) of the foundation pile (1) a vibration of the foundation pile and especially the lower part and end of the foundation pile will result.

Figure 6:
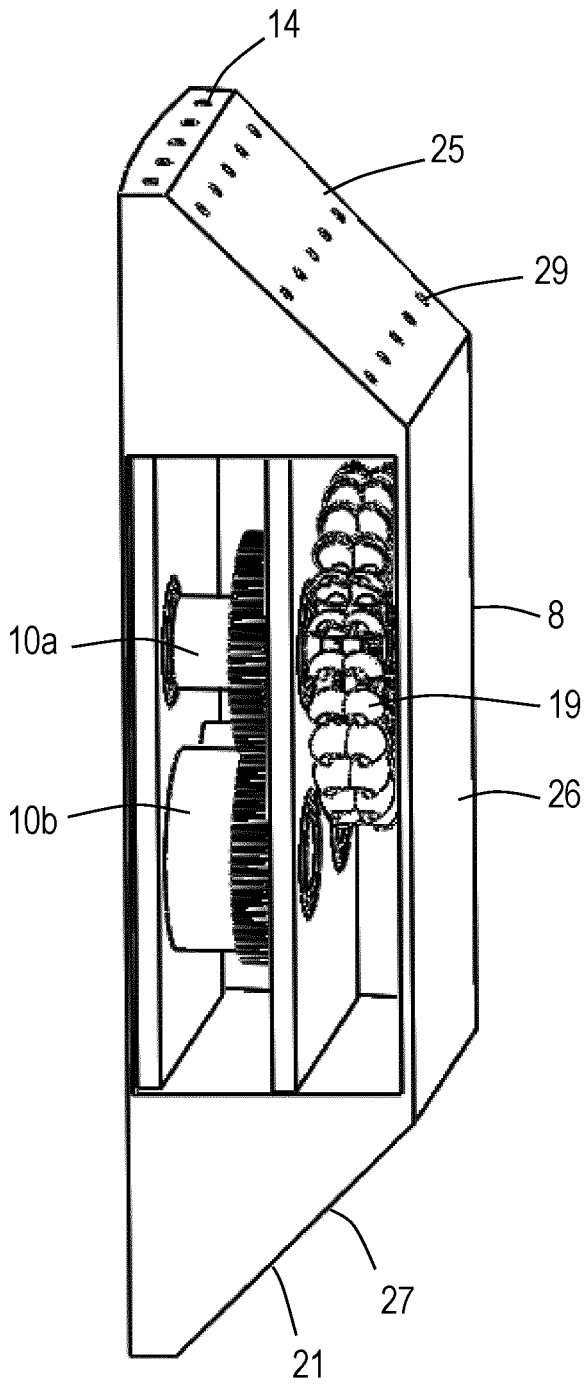

The configuration as shown in FIG. 5 is placed in a housing (26) as shown in FIG. 6. This housing will also comprise the outflow openings (14) and (29) of the means (6) to discharge a fluid into the interior space (20) of the tubular housing (2) at an upper frusto conical surface (25) and openings (16) (not visible) of the means (7) to discharge a fluid from the lower end (4) of the tubular housing (2) at a lower frusto conical surface (27). When such a device (8) is placed in a ring the axis of rotation (11*a*, 11*b*) of the eccentric masses (10*a*, 10*b*) are directed in a radial direction with respect to the ring shaped element (17).

Figure 7:
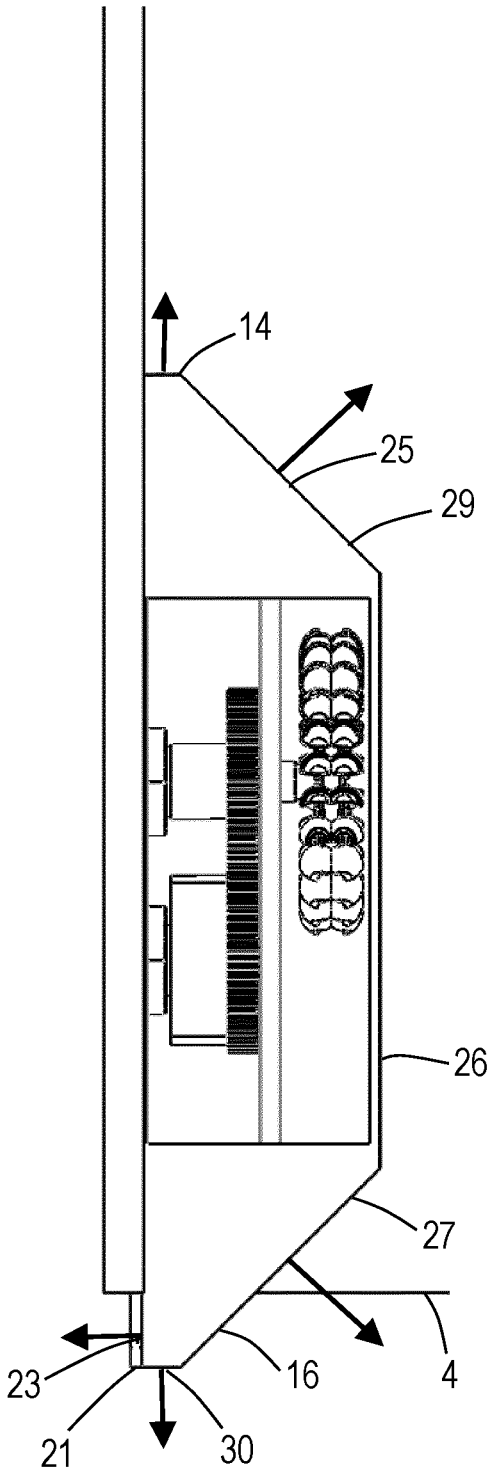

FIG. 7 shows how ring shaped element (17) is connected to the lower end (4) of the tubular housing (2). Ring shaped element (17) extend somewhat below the lower end (4) to enable a jet of fluid (arrow indicating flow direction) to be discharged via outlet openings (23) sideways, i.e. in a radially outward direction. At the downwardly lower pointed end (21) of the ring shaped element (17) outlet openings (30) are present which direct the fluid in a downward direction as indicated by an arrow. In this Figure also the positions and flow directions of all the other openings (16,29,14) are shown and indicated by arrows. Also pointed end (21) is shown as a non-moving pointed end or arrangement. The only moving parts are the wheels (19) and eccentric masses (10*a*, 10*b*) of the individual vibrating devices (8).

Figure 8:
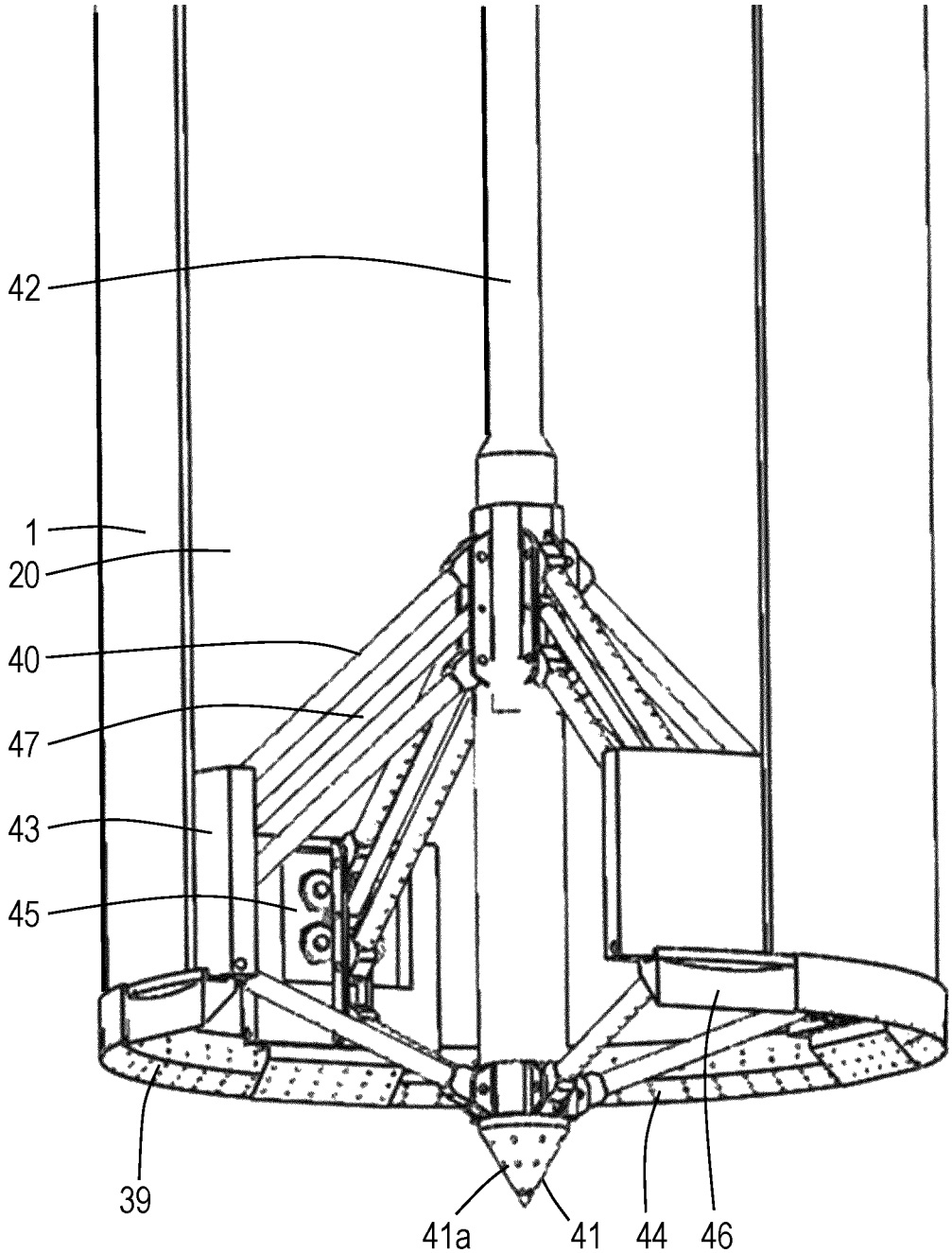

FIG. 8 shows a ring shaped element (39) which is detachably connected to the interior wall of the tubular housing. Ring shaped element (39) is provided with openings to discharge a fluid into the interior space (20) of the tubular housing as shown in FIG. 3 and openings to discharge a fluid from the lower end of the tubular housing in a direction which has a downward directional component as shown in FIG. 3. Hydraulic operated cross bars (40) are seen which press the ring shaped element (39) to the inner wall of the tubular housing from a central element (41). This central element (41) is connected to the upper end of the foundation pile with an umbilical (42) through which hydraulic fluid, water and/or air can be transported to the ring shaped element (39) via the cross-bars. The central element itself is also provided with openings (41*a*) to discharge water in a downward direction. The cross-bars are provided with outlet openings for a fluid in a downward and upward direction. FIG. 8 shows the eccentric masses (45) to vibrate the pile in axial and/or torsional direction. All the eccentric masses in the four pressing elements (43)) that hold the eccentric masses are connected via axles (47) that are connected in the central element (41). This enables that all the eccentric masses to rotate in the same phase and frequency, generating an uniform vibration.

Figure 9:
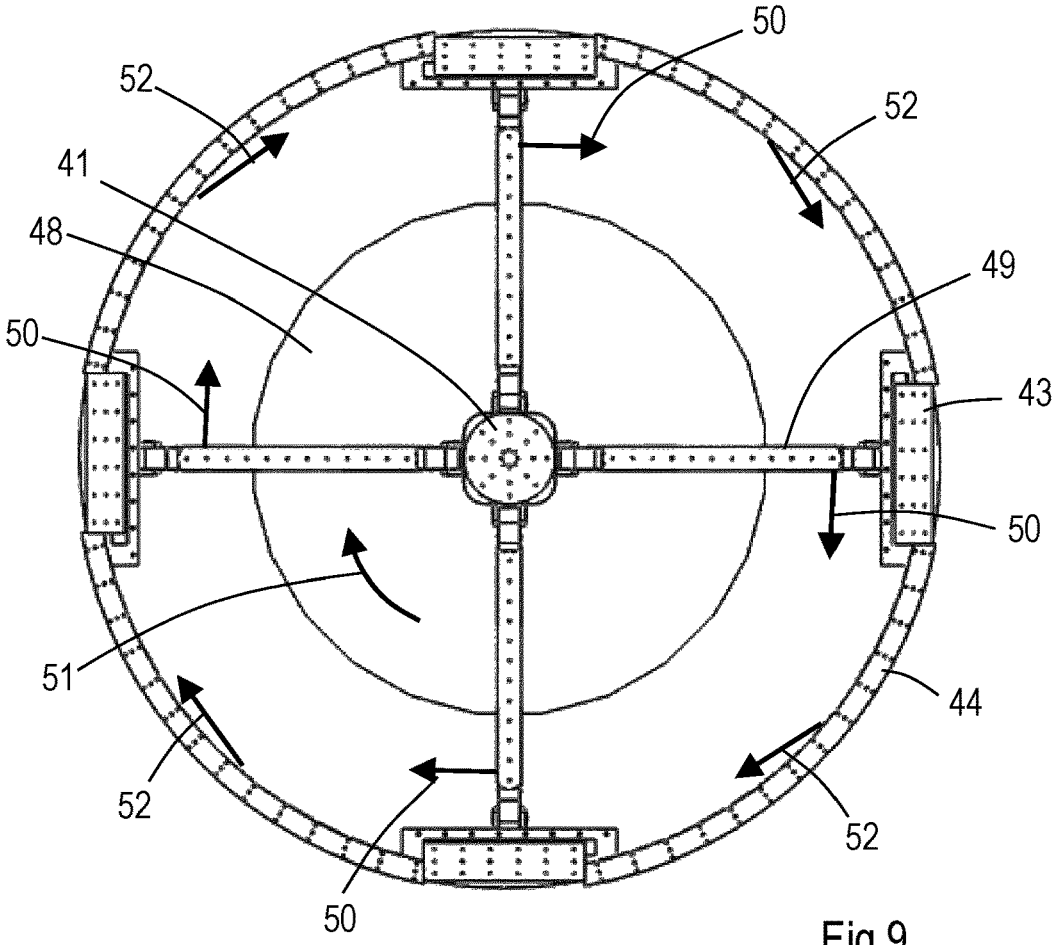

FIG. 9 shows the foundation pile of FIG. 8 as seen from below. Also a smaller diameter upper opening (48) of the foundation pile is shown.

Figure 10:
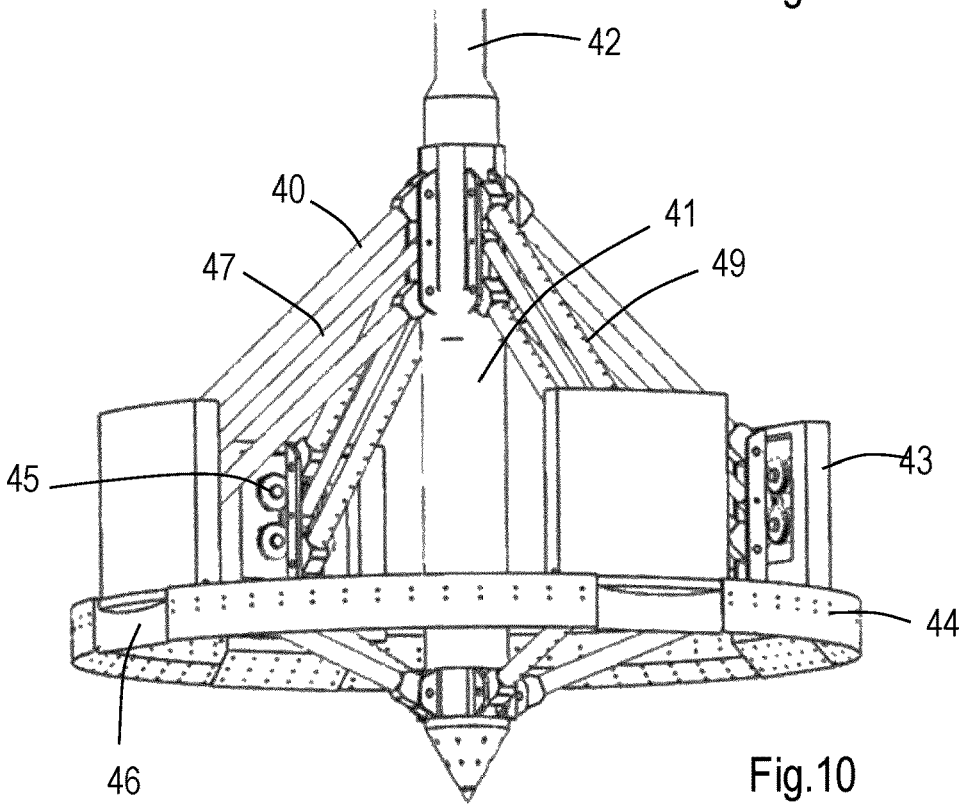

FIG. 10 shows the detachable ring formed element of FIG. 8 without showing the foundation pile. As can be seen the ring shaped element (39) is comprised of four pressing elements (43) each connected to the central element (41) via the one or more hydraulic bars (40). Each pressing element (43) is provided with a hydraulic clamp (46) to fix to the lower end of the pile. The hydraulic bars (40) force the pressing elements (43) to the inner wall of the foundation pile. Connecting elements (44) are present in between these four pressing elements. Both pressing elements (43) and connecting elements (44) are provided with downward and inwardly directed openings for discharge of a fluid as shown. The pressing elements are further provided with one or more vibration devices (45) in a cut out view. The vibration devices (45) may be as shown in FIG. 5.

FIGS. 9 and 10 further show a supply conduit (49) for fluid having openings at its upper and lower end to discharge a fluid in a vertical direction. In a preferred embodiment also openings at one side of the supply conduit (49) are present to discharge the fluid in a horizontal and tangential direction as indicated by arrows (50) for one such opening on the supply conduit (49) for fluid. The connecting elements (44) of the ring shaped element (39) may also be provided with openings to discharge a fluid in a horizontal and tangential direction as indicated by arrows (52). Such a tangential discharge of fluid results in a vortex (51) having a direction indicated by arrow (51) in FIG. 9. The fluid is discharged in a substantial horizontal direction and will spirally flow in such a vortex in an upward direction. Excess water is discharged from the foundation pipe at a more elevated level. In an even more preferred embodiment the openings at the side of conduit (49) are designed such that more than 70% of the fluid being discharged from the openings on the supply conduit are discharged from the openings at one side and wherein the remaining fluid may be discharged from the optional openings at the upper and lower end of the supply conduit (49).

Figure 11:
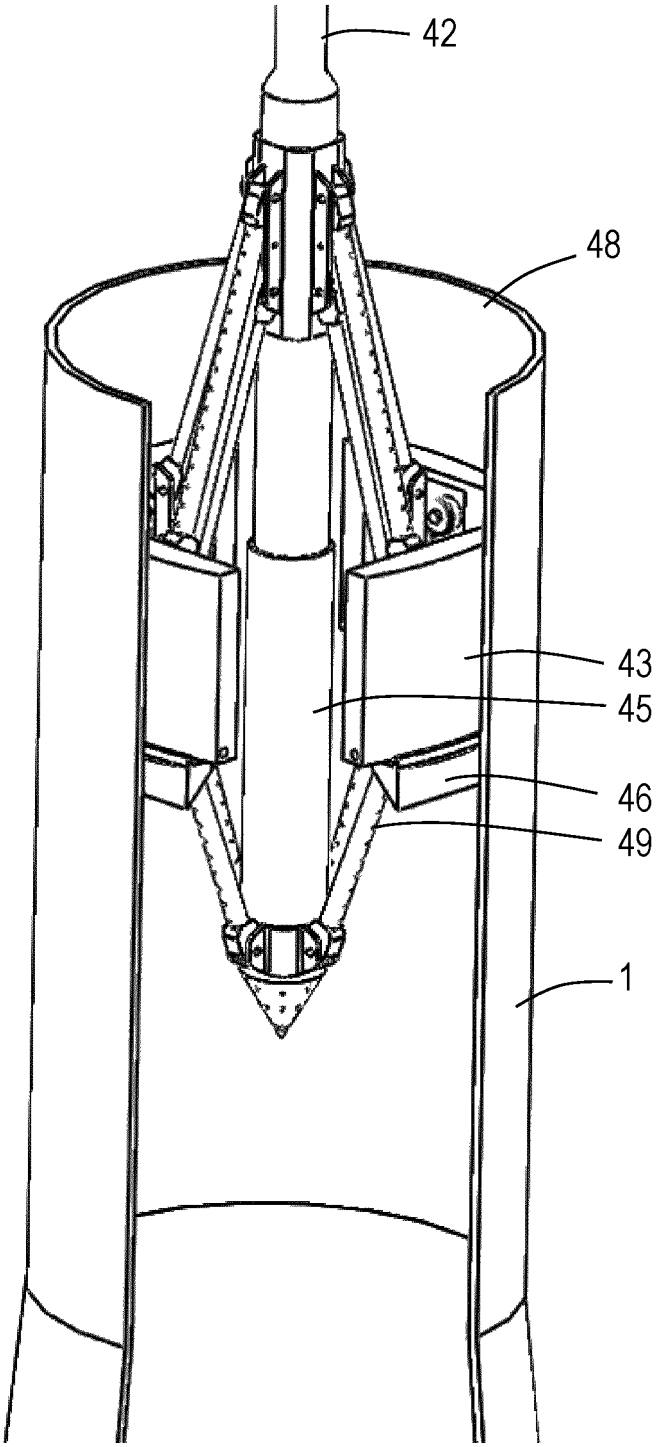

FIG. 11 shows how the detachable ring (39) is collapsed to a more slimmer shape and removed through the smaller diameter opening at the upper end of the foundation pile. As can be seen only the pressing elements (43) are removed while the connecting parts (44) of the ring remain attached to the lower end of the foundation pile. In this way the more complex vibration means may be recovered after installing the foundation pile.

The invention is thus also directed to a detachable vibration device for use in a tubular foundation pile comprising of a central element connected to radially extending and in length variable actuators, the actuators connected at their radial end with a pressing element provided with a clamp suited to press the clamp to the lower end of the tubular foundation pile, wherein the pressing elements are provided with vibration means and with means to discharge a fluid from the lower end of the tubular housing in a direction which has a downward and upward directional component and wherein the vibration device is further provided with means to discharge a fluid into the interior space of the tubular housing of the tubular foundation pile.

Preferably the vibration means are rotating eccentric masses and wherein the axis of rotation of the eccentric masses are directed in a radial direction with respect to the tubular foundation pile and wherein the axis of rotation are connected by axles to the central element such that the movement of the eccentric masses move in the same phase and frequency.

The invention claimed is:

1. A detachable fluidisation device for use in a tubular foundation pile having a tubular housing with a lower end, the detachable fluidisation device comprising:

a central element connected to radially extending and variable length actuators, the actuators connected at their radial ends with pressing elements each provided with a clamp suited to press the clamp to the lower end of the tubular foundation pile, wherein the pressing elements are provided means to discharge a fluid from the lower end of the tubular housing in a direction which has a downward directional component and means to discharge the fluid from the lower end of the tubular housing in a direction which has an upward directional component, and wherein the device is further provided with means to discharge the fluid into the interior space of the tubular housing of the tubular foundation pile.

2. A detachable fluidisation device according to claim 1, wherein the pressing element is further provided with vibration means, wherein the vibration means are rotating eccentric masses, wherein the axis of rotation of the eccentric masses are directed in a radial direction with respect to the tubular foundation pile, and wherein the axis of rotation are connected by axles to the central element such that the eccentric masses move in the same phase and frequency.

3. A detachable fluidisation device according to claim 1, wherein the means to discharge a fluid into the interior space of the tubular housing of the tubular foundation pile has a tangential directional component.

4. A detachable fluidisation device according to claim 1, wherein the pressing elements are further provided with vibration devices comprising of a motor connected to a rotating eccentric mass, and wherein the motor is an electric, pneumatic or hydraulic motor.

5. A detachable fluidisation device according to claim 1, wherein the number of pressing elements is four.

6. A detachable fluidisation device according to claim 1, wherein the pressing elements form a ring shaped element when the clamps of the pressing elements are pressed to the lower end of the tubular foundation pile.

7. A detachable fluidisation device according to claim 6, wherein the ring shaped element has a pointed inner surface and wherein the pointed inner surface is provided with outlet openings to discharge the fluid from the lower end of the tubular housing in a direction which has the downward directional component and a radial inward directional component.

8. A detachable fluidisation device according to claim 7, wherein at the downwardly pointed end of the ring shaped element additional outlet openings are present which direct the fluid in a downward direction.

9. A detachable fluidisation device according to claim 7, wherein the ring shaped element is provided with additional outlet openings at an outer surface of the ring shaped element to discharge a fluid from the lower end of the tubular housing in a direction which has a radial outward directional component.

10. A detachable fluidisation device according to claim 1, wherein a supply conduit is present for supplying the fluid to the pressing elements and wherein the supply conduit is provided with openings at its upper and lower end to discharge the fluid in a vertical direction.

11. A detachable fluidisation device for use with a fluid and a foundation pile having a tubular housing with an interior space and a lower end, the detachable fluidisation device comprising:

a ring-shaped element having a plurality of first outlet openings configured to discharge the fluid into the interior space of the tubular housing, and a plurality of second and third outlet openings configured to discharge the fluid from the lower end of the tubular housing in directions that have downward and upward directional components, respectively;

a plurality of pressing elements each including a clamp adapted to press the ring-shaped element to the lower end of the tubular housing;

a plurality of radially extending and variable-length actuators each having a radially outward end connected to a respective one of the pressing elements; and a central element connected to the actuators, wherein in use the fluidisation device operates to discharge the fluid to move the foundation pile downwards into soil.

12. A detachable fluidisation device according to claim 11, wherein the pressing elements each further include a rotating eccentric mass that generates vibration, wherein each rotating eccentric mass rotates about an axle defining an axis of rotation directed in a radial direction with respect to the tubular housing, and wherein each axle is connected to the central element so that the eccentric masses move in the same phase and frequency.

13. A detachable fluidisation device according to claim 12, wherein the pressing elements each further include a motor connected to the rotating eccentric mass, wherein the motor is an electric, pneumatic, or hydraulic motor.

14. A detachable fluidisation device according to claim 11, wherein the number of pressing elements is four.

15. A detachable fluidisation device according to claim 11, wherein the first outlet openings have a tangential directional component.

16. A detachable fluidisation device according to claim 11, further comprising a supply conduit adapted to supply the fluid to the pressing elements, wherein the supply conduit includes upper and lower ends with openings to discharge the fluid in a vertical direction.

17. A detachable fluidisation device according to claim 11, wherein the pressing elements form the ring-shaped element when the clamps of the pressing elements are pressed to the lower end of the tubular housing.

18. A detachable fluidisation device according to claim 17, wherein the ring-shaped element includes a pointed inner surface forming fourth outlet openings configured to discharge the fluid from the lower end of the tubular housing in a direction that has the downward directional component and a radial inward directional component.

19. A detachable fluidisation device according to claim 18, wherein the ring-shaped element includes a downwardly pointed end forming fifth outlet openings configured to discharge the fluid in a downward direction.

20. A detachable fluidisation device according to claim 18, wherein the ring-shaped element includes an outer surface forming sixth outlet openings configured to discharge a fluid in a direction that has a radial outward directional component.

* * * * *